US005607626A

United States Patent [19]

Kunkle et al.

[11] Patent Number: 5,607,626

[45] Date of Patent: Mar. 4, 1997

[54] SPRING ASSISTED MULTI-NOZZLE DESUPERHEATER

[75] Inventors: Timothy E. Kunkle, McKean; Allan K. Shea; Richard F. Kuntz, both of Erie, all of Pa.

[73] Assignee: Copes-Vulcan, Inc., Lake City, Pa.

[21] Appl. No.: 516,567

[22] Filed: Aug. 18, 1995

[51] Int. Cl.[6] ..... B01F 3/04

[52] U.S. Cl. ..... 261/27; 261/37; 261/66; 261/116; 261/DIG. 13

[58] Field of Search ..... 261/66, 34.1, 76, 261/115, 116, 117, DIG. 13, DIG. 39, 37, 27

[56] References Cited

U.S. PATENT DOCUMENTS

| | | | |
|---|---|---|---|
| 3,219,323 | 11/1965 | Spence | 261/66 |
| 4,442,047 | 4/1984 | Johnson | 261/66 |
| 5,290,486 | 3/1994 | Enarson | 261/66 |
| 5,336,451 | 8/1994 | Lovick | 261/116 |
| 5,380,470 | 1/1995 | Jacobsson | 261/16 |

*Primary Examiner*—Khanh P. Nguyen

*Attorney, Agent, or Firm*—Pearne, Gordon, McCoy & Granger

[57] ABSTRACT

A steam desuperheater has a body extending into a steam line and is operated by a controlled variable water pressure source responding to the amount of superheat in the steam line. As the pressure of the supply line is increased above a predetermined level greater than the steam pressure in the steam line, a piston moves up against a calibrated spring to progressively uncover a plurality of spray openings so that increasing water pressure results in an increasingly greater amount of water sprayed into the steam line.

10 Claims, 2 Drawing Sheets

SPRING ASSISTED MULTI-NOZZLE DESUPERHEATER

BACKGROUND OF THE INVENTION

This invention relates generally to steam desuperheaters and more particularly to a spray desuperheater for spraying water into a steam pipe to maintain the steam at a predetermined temperature level.

Many applications using steam operate most efficiently using steam that is saturated or slightly superheated, while many steam generators such as boilers tend to produce steam that is sometimes excessively superheated. This is particularly true where the steam demand of the application changes more rapidly than the output response of the steam generator. Under these conditions, the optimum efficiency can be obtained by powering the steam generator to produce superheated steam, and then reducing the amount of superheat by injecting water into the steam.

A common type of water injection uses a spray head placed at the middle of the steam pipe and having a fixed spray nozzle adapted to produce a fine spray of water downstream into the flowing steam. The actual volume of water injected into the steam is therefore varied by changing the pressure of the water supply, and the pressure must always be maintained well above that of the steam in the line at the nozzle. Because the amount of superheat varies with the amount of steam production and the rate of flow, among other variables, the only true regulation can be made by sensing the temperature of the steam at a point downstream where the injected water has been completely vaporized and heated so that equilibrium conditions have been reached. This requires a spray nozzle that is optimized for a certain rate of flow, and if the flow rate is varied outside of certain parameters, the resulting spray pattern may not give prompt enough heat transfer to allow an equilibrium condition to be sensed and proper steam conditions be attained. However, such desuperheaters work well when the spray requirements vary over only a narrow range.

When a greater variation in spray volume is required, other types have been used, including variable orifices and the use of a separate steam path for premixing with the water flow. Another arrangement has been the use of multiple nozzles with a moving plug or slide member uncovering or selecting different nozzles for spraying the water. One such arrangement which has proved successful has been a multiple nozzle spray unit disclosed in U.S. Pat. No. 4,442,047, owned by the assignee of this application. This unit uses a spray tube extending into the steam line and has a plurality of small nozzles on the downstream side spaced varying distances from the end. The nozzles are connected to a bore and a hollow plug is moved to and from the end to uncover different numbers of nozzles to vary the volume of water being sprayed. The position of the plug is determined by a valve stem which is moved linearly by a diaphragm actuator which in turn is controlled in response to signals from a temperature sensor located downstream in the steam line. The complexity of the actuating system results in high original cost as well as high maintenance after installation.

SUMMARY OF THE INVENTION

The present invention provides a water spray nozzle desuperheater which combines the control simplicity of a single nozzle mechanical spray desuperheater with the wide modulation range and variable capacity of a multi-nozzle spray desuperheater. A fixed nozzle desuperheater relies on variations on water line pressure above the prevailing pressure in the steam line to in turn vary the volume and hence mass of the water being injected. On the other hand, multi-nozzle injectors tend to use water at a fixed and controlled steady inlet pressure and utilize a separate controller to move a plug to uncover varying number of nozzles and vary the amount of water injected into the steam line as disclosed in the aforesaid patent, U.S. Pat. No. 4,442,047, which is incorporated herein by reference.

The present invention provides a novel desuperheater spray unit which consists of a spray tube having a multiple number of nozzles arranged in a helical array along the axis of its bore and control of these nozzles is made by a moving plug or piston having a hollow bore. The plug is arranged to move in the main bore of the spray tube to which the nozzles are connected and has a reduced diameter bore through which the water enters the unit. The spray tube also contains a calibrated spring adapted to bias the plug to the off position. The plug, because of the differential areas of the bores, is under a differential hydraulic force tending to move the plug toward the full open position, where all nozzles are operating, against the biasing force of the spring. Thus, the water pressure itself supplied through a control valve to the desuperheater unit operates to move the plug so that initially varying the flow of the inlet water results in a buildup of pressure in the spray tube which lifts the plug and varies the number of nozzles that are uncovered for spraying purposes. Once the full number of nozzles are open, further increasing the water pressure will continue to increase the water flow through the nozzles.

According to the present invention temperature measurements are taken at a point downstream in the steam line a sufficient distance that the injected water has been vaporized into steam and an equilibrium condition prevails. These readings will determine the temperature of the steam at that point and this reading is then used by a controller unit which compares the measured variable against the required set point and generates a signal to operate a control valve whose outlet is in turn connected to the desuperheater unit. The control valve may be of any well known type which can be used to vary the water pressure at the outlet independent of the rate of flow. Thus with proper calibration the control valve will supply water to the desuperheater at a pressure sufficient to move the plug to a position where the desired amount of water is sprayed into the steam line to reduce the amount of superheat to the desired level.

DETAILED DESCRIPTION OF THE PREFERRED EMBODIMENT

Figure 1:
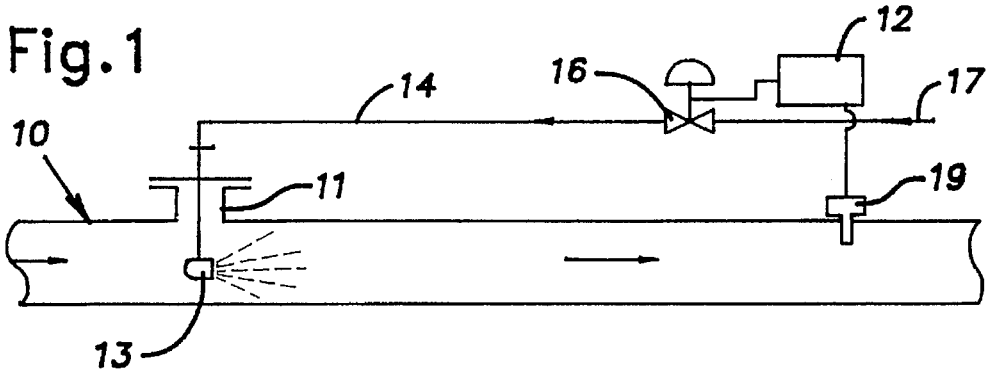
FIG. 1 is a schematic a view of a steam line incorporating the desuperheater of the present invention.

Referring now to the drawings in greater detail and to FIG. 1, this shows a schematic arrangement for utilizing the desuperheater unit according to the present invention. In a portion of a steam line 10, a mounting fitting 11 is provided on the sidewall and a spray unit 13 is mounted on the fitting as described hereinafter. Spray unit 13 is supplied with water under pressure through a water line 14 from control valve 16 connected in turn to a suitable high pressure water supply 17. The control valve 16 operates to control the flow of water into the water line 14 in response to a temperature sensor 19 mounted in the steam line 10 a spaced distance downstream from the spray unit 13. This temperature sensor sends a measured variable to a temperature controller 12 which evaluates this against a desired set point and sends a corrective signal to the control valve 16. The distance to the sensing element is chosen to be sufficient to allow the steam to come to equilibrium after the water has been injected to give a true reading of the temperature of the steam. Thus, the control valve 16 by varying the water flow produces a varying water pressure in line 14 which is greater than the pressure in the steam line 10. A suitable controller for this purpose is a Series 40 pneumatic controller made by Ametek PMT Division in Feasterville, Pa.

Figure 2:
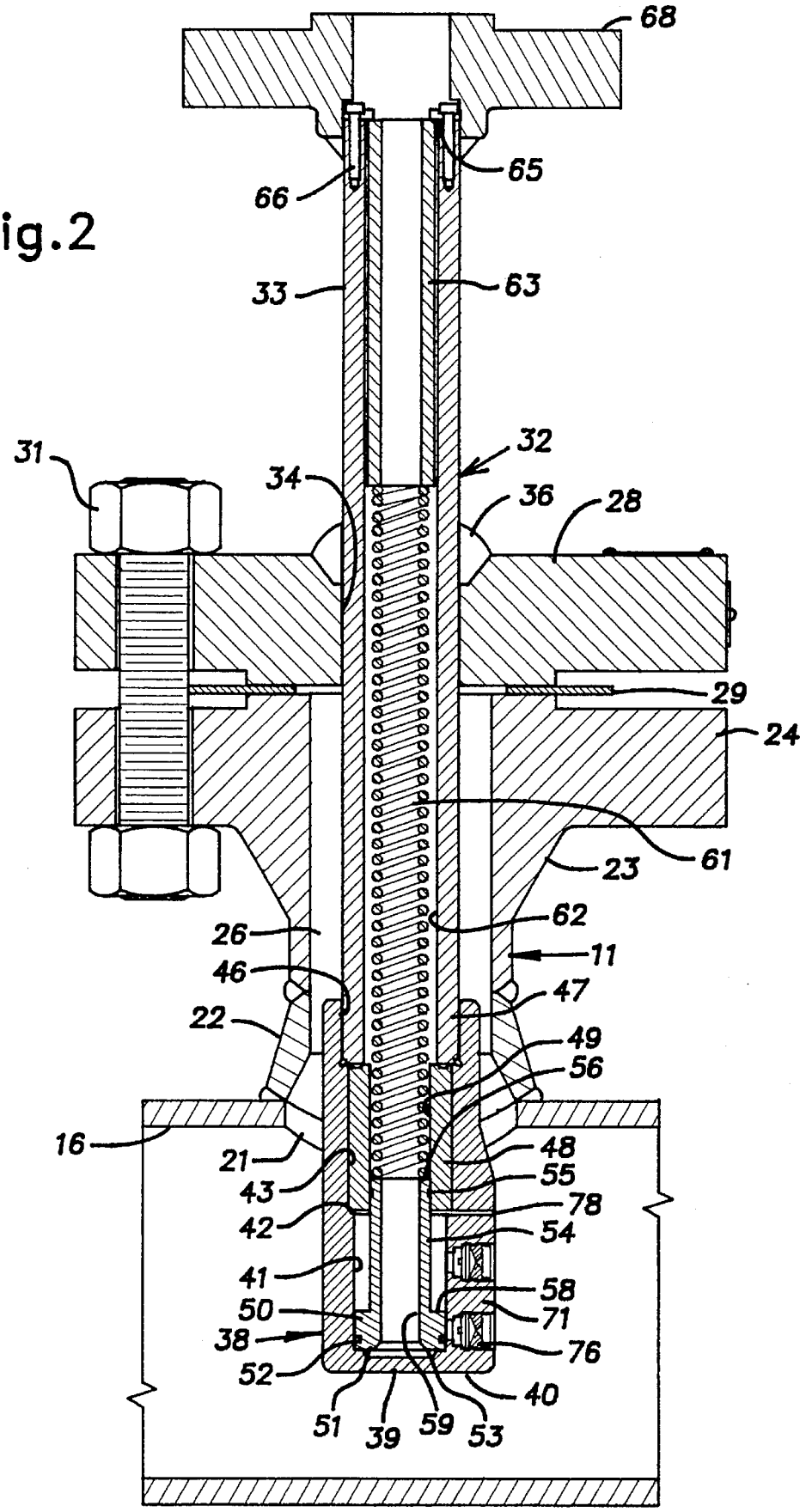
FIG. 2 is a enlarged cross-sectional view of the spray unit shown in FIG. 1.

Turning to FIG. 2, which shows the spray unit in greater detail, the mounting flange 11 fits over an opening 21 in the wall of the steam line 10 and includes a weld saddle 22 welded directly to the steam line over the opening 21. At the upper end, the weld saddle 22 is connected by welding to a weld flange 23 having a standard pipe flange 24 at the outer or upper end. It should be understood that the entire mounting flange assembly 11 is substantially permanently attached to the steam line and will remain in place while the remainder of the spray unit 13 can be removed and replaced as desired.

The weld flange 23 has a large bore 26 extending into the interior of the steam line 10, and connected to the flange 24 is a mounting flange 28 connected to the flange 24 with gaskets 29 and suitable bolts 31 for a standard pipe flange assembly. The spray unit 13 is mounted on flange 24 and has a body 32 which includes a spray head or inner portion 38 and a support tube or outer portion 33 which extends through a closely sized opening 34 formed in the mounting flange 28. Support tube 33 is secured to the flange by means of a suitable weld 36 at the outer side to prevent any possible leakage around the support tube from the steam line 10. The support tube 33, when the mounting flange 28 is secured in place, extends inward adjacent the weld saddle 22, where it is connected to the spray head 38.

The spray head 38 is a generally cup-shaped member having a bottom wall 39 with a flat end surface 40. Above the bottom wall 39 is a main bore 41 which terminates at a shoulder 42, where it joins a slightly enlarged counterbore 43. At its upper end, the counterbore 43 opens into a threaded bore 46 which is threaded onto the bottom end 47 of the support tube 33. A sleeve 48 is positioned within the counterbore 43 to abut against the shoulder 42 and the support tube end 47 without movement. Thus, when the spray head is mounted on the support tube, the threaded bore 46 is screwed onto the end 47 until it abuts the sleeve 47, after which it is preferable to weld the spray head directly to the support tube to prevent any possible loosening of this joint.

A piston or plug 50 is slidably mounted within the spray head 38 and has a head 51 having a sealing or piston ring 52 which makes a sliding sealing fit within the main bore 41. The piston end face 53 normally abuts against the bottom wall 39 when the spray head is in the "OFF" position, as explained in greater detail hereinafter. The piston 50 has a reduced diameter shank 54 which extends up into the bore 49 of the sleeve 48, where it carries a sealing ring 55 to make sealing contact with the bore 49, and shank 54 terminates in an annular end face 56. Likewise, an annular face 58 is formed where the shank 54 joins the head 51, and the piston 49 has a bore 59 extending therethrough from end-to-end.

A helical spring 61 is positioned within the bore 62 and the support tube 33 and abuts at its lower end on the shank end face 56. The spring 61 is made generally quite long to give a relatively low rate and a relatively high preload preload and extends upward to abut against the lower end of a tubular spacer 63 located in the upper end of the bore 62. The spacer 63 in turn abuts against a washer member 65 secured to the top end of the support tube 33 by suitable screws 66. A pipe flange 68 is welded on the upper end of the support tube 33 for connection to the water line 14 in the usual manner.

Figure 4:
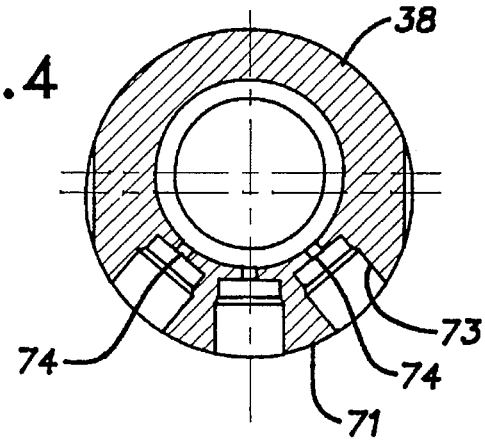
FIG. 4 is a cross-sectional view of the nozzle head taken on line 4—4 of FIG. 3.
Figure 3:
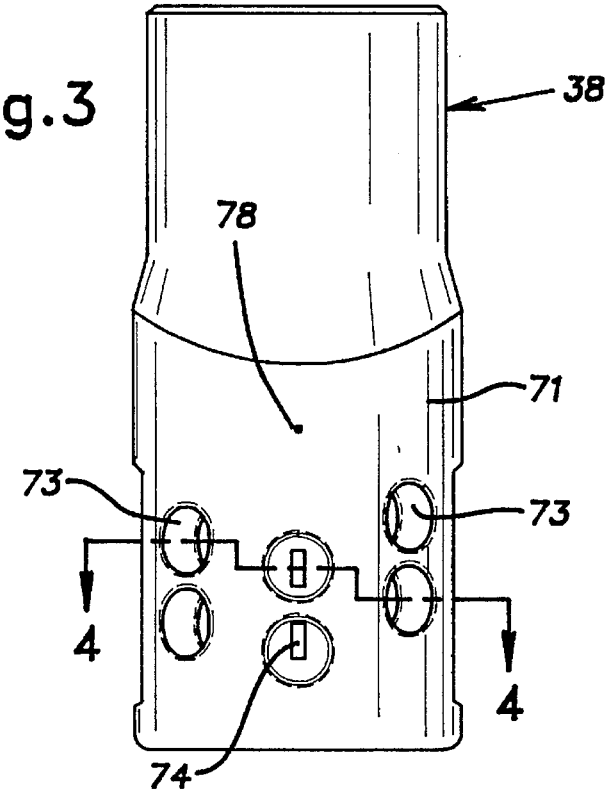
FIG. 3 is an elevational view of the nozzle head looking in the upstream direction.

The lower end of the spray head adjacent the main bore 41 has a thickened spray wall 71 which is also circular in shape, but formed on a radius that is shifted to the downstream side from the axis of the support tube 33 to provide the largest diameter that can be inserted through the bore 26. The spray wall 71 contains the spay nozzles which, as shown in FIGS. 3 and 4 may be, by way of example only, 6 in number, spaced one above each other in a staggered pattern. Each of the spray nozzle openings comprises a tapped hole 73 extending partially through the spray wall 71 from the exterior where it connects with a rectangular opening 74 connected to the main bore 41. A suitable spray nozzle insert 76 is screwed into the tapped hole 73 and staked in place, and the nozzle insert 76 is so shaped to provide a fine atomizing spray in the downstream direction. The spray wall 71 also has a small bleed hole 78 extending from the exterior into the shoulder 42 to allow fluid trapped around the piston shank 54 to escape to the exterior and prevent blocking of the piston movement.

The spray head is normally in the "OFF" position with the piston head 51 abutting the spray head bottom wall 39, and the operation is controlled by the pressure of the water from the water line 14. The helical spring 61 has a calibrated rate and preload determined for the pressure of the steam within the line 10. Thus, the valve is not allowed to open until the pressure in the water line 14 is a predetermined value above the pressure end of the line 10 to ensure positive water flow through the spray nozzle inserts 76. When the pressure in the water line 14 exceeds this predetermined value, the pressure, because of the differential between the areas on the piston head end face 53 tending to move the piston in the upward direction and the pressure against the shank end face 56 opposing that movement, the net force is exerted on the helical spring 61, and after the preload has been overcome, the piston begins to move upward so that the end face 53 begins to uncover the lowermost of the rectangular openings 74. As the piston begins to move upward as determined by the rate of the spring 61, the openings 74 are so positioned that as one is completely uncovered, the next begins to be uncovered so that the actual area of the openings increases in a substantially linear fashion, since the vertical height of the openings 74 is substantially equal to the differential spacing between the various tapped holes 73. As the piston moves upward, any water trapped around the shank 54 within the main bore 41 is allowed to bleed out through the bleed hold 78 to prevent any locking action which would prevent piston movement. When the piston reaches the top of its stroke where the annular face 58 abuts the lower end of the sleeve 48, all of the rectangular openings 74 will have been uncovered, but although the area can no longer increase, increasing pressure will still cause in an increasing amount of water discharge into the steam because of the increased pressure differential across the nozzles.

The operation of the spray unit is therefore controlled entirely by the pressure level of the water supplied through the water line 14 from the control valve 16, as determined by signals sent from the controller. The controller 12 senses the temperature within the steam line 10 at the sensor 19, which is located far enough downstream that any injected water will have completely vaporized, and it is often desirable to use multiple sensors at this point to get an accurate reading. Assuming that the steam at this point is saturated, there is no reason to add water, and the controller 12 will direct the control valve 16 to remain closed so that no water enters the supply line 14. The piston 50 will then be in the position shown in FIG. 2, and the space in the main bore 41 around the piston shank 54 will be at the pressure within the steam line, since the steam pressure can move back through the spray nozzles 76 and the bleed hole 78 into the space, and the piston will be held by that pressure and the force of the spring 61 in the fully closed position.

As pressure is built up through the supply line 14, assuming that there is a demand for water because of superheat in the steam, as determined by the controller 12, this pressure acts on the shank end face 56 in a downward direction and by passing through the bore 59 and the piston 50, it also acts in an upward direction on the piston end face 53. Because of this construction, the area of the piston end face 53 is equal to the sum of the areas of the shank end face 56 and the annular face 58, so that there is no upward force on the piston 50 until the pressure line 14 begins to exceed the pressure in the steam line 10. Since the net area of the end face 43 that is effective to force the piston in an upward direction exactly equal to the annular area 58, an upward force results whenever the pressure in the supply line 14 exceeds that in the steam line 10, and this is opposed only by the preload of the spring 61.

Assuming, by way of example, that the spring 61 has a preload of sixty pounds when the piston 50 is in the lowermost position, and a force of two hundred pounds when the piston is in the uppermost position, and that the area differential when the piston end face 53, which is equal to the annular area 58, has an area of one square inch, the pressure in the water line 14 must be raised to a pressure of sixty pounds above the pressure in the steam line 10 before the piston 50 can begin to move upward. If the pressure line 14, as regulated by the controller 12 and the control valve 16, begins to increase further in response to a growing amount of superheat in the steam line 10, the piston 50 will start to move upward to uncover the lowermost rectangular opening 74, and water will exit through the adjacent nozzle insert 76 and atomize, forming a mix with the steam downstream away from the spray unit 13. The control valve will allow an increasing flow, and hence, pressure of water into the line 14, and if the pressure in line 14 rises to two hundred PSI, at this point, the piston 50 will be in the uppermost position, and the annular face 58 will engage the lower end of the sleeve 48 to prevent further movement. Any increase in pressure from the line 14 will allow further spray only because of the increasing force of the water through all of the openings 74 and nozzle inserts 76, which are now in the fully open position.

It will therefore be seen that control is obtained entirely through a single control valve 16 and controller 12 adapted to regulate the rate of flow, and hence, the pressure of the water in line 14. Furthermore, it will be seen that this arrangement produces a smooth, continuous variation over a much wider range as compared to single nozzle spray units, and the extent of this range can be varied, depending upon the number and size of the opening and nozzle inserts.

The amount of preload in the spring 61 is determined by the minimum pressure desired through the spray nozzle 61 to obtain proper vaporization of the water. The upper pressure level, here again given by example as two hundred PSI, is determined by other parameters of the system, such as sensitivity and spray performance, at such higher pressures.

Although the preferred embodiment of the invention has been shown in the drawings and disclosed in the detailed description, it is recognized that other modifications and rearrangements may be resorted to without departing from the scope of the invention as defined in the claims.

We claim:

1. A steam desuperheater for a steam line having a side wall and a fitting on said side wall, comprising a body extending axially through said fitting into the interior of said steam line, said body having an outer portion at said fitting and an inner portion adjacent the center of said steam line, said body having an axial bore therein, a piston slidably mounted in said bore with a head portion making sealing engagement with said bore, said piston having a head end face, spring means biasing said piston in one direction in said bore, a plurality of spray openings spaced axially on said body and connected to said bore, and means to supply water under variable pressure to said bore so that increasing said pressure above a predetermined level forces said piston to move against the force of said biasing spring means to progressively uncover an increasing number of said spray openings.

2. A steam desuperheater as set forth in claim 1, including stop means engageable by said piston limiting movement of said piston in said one direction.

3. A steam desuperheater as set forth in claim 2, wherein all of said spray openings are covered when said piston engages said stop means.

4. A steam desuperheater as set forth in claim 3, wherein said spring has a preload such that said water pressure must exceed a predetermined level before any of said spray openings are uncovered.

5. A steam desuperheater as set forth in claim 4, including a second stop means engageable by said piston when all of said spray openings are uncovered.

6. A steam desuperheater for a steam line having a side wall and a fitting on said side wall, comprising a body extending axially through said fitting into the interior of said steam line, said body having an outer portion at said fitting and an inner portion adjacent the center of said steam line, said body having a first bore in said outer portion and a second bore in said inner portion, said second bore being larger in diameter than and coaxial with said first bore, a piston slidably mounted in both of said bores with a head portion making sealing engagement with said second bore and a shank portion making sealing engagement with said first bore, said piston having a head end face and a shank end face, said piston having a small bore extending axially from said shank end face to said head end face to allow water to flow from said fitting to said second bore, wall means closing said second bore, spring means biasing said piston toward said wall means, a plurality of spray openings spaced axially on said body on said inner end and connected to said second bore, and means to supply water under variable pressure to said fitting and said first bore so that increasing said pressure above a predetermined level forces said piston to move away from said wall means to uncover an increasing number of said spray openings.

7. A steam desuperheater as set forth in claim 6, including a stop on said wall means to limit movement of said piston away from said fitting.

8. A steam desuperheater as set forth in claim 6, wherein said body has a shoulder at the end of said first bore at said second bore and said piston annular face between said head end and said shank end.

9. A steam desuperheater as set forth in claim 8, wherein an engagement of said annular face and said shoulder occurs only when all of said spray openings are uncovered.

10. A steam desuperheater as set forth in claim 6, wherein said spring means has a preload to prevent movement of said piston away from said plug means until the pressure of said water precedes a predetermined level.

* * * * *